United States Patent [19]

Gonzales

[11] Patent Number: 5,002,271

[45] Date of Patent: Mar. 26, 1991

[54] PORTABLE LEG EXERCISER

[76] Inventor: Ike T. Gonzales, #28, Road 3494, Flora Vista, N. Mex. 87415

[21] Appl. No.: 349,875

[22] Filed: May 9, 1989

Related U.S. Application Data

[63] Continuation of Ser. No. 195,140, May 17, 1988, abandoned.

[51] Int. Cl.[5] ..... A63B 21/02

[52] U.S. Cl. ..... 272/134

[58] Field of Search ..... 272/134, 135, 136, 138, 272/144, 145; 297/16, 17, 19, 64

[56] References Cited

U.S. PATENT DOCUMENTS

| | | | |
|---|---|---|---|
| 663,486 | 12/1900 | Boren | 297/19 |
| 1,275,649 | 8/1918 | Blando | 297/17 |
| 1,715,870 | 6/1929 | Spain | 272/72 |
| 3,043,591 | 7/1962 | Sellner | 272/144 |
| 3,664,666 | 5/1972 | Lloyd | 272/134 |
| 4,254,949 | 3/1981 | Brentham | 272/130 X |
| 4,466,613 | 8/1984 | Reese | 272/136 |
| 4,509,746 | 4/1985 | Mask | 272/134 |
| 4,582,319 | 4/1986 | Luna | 272/136 |
| 4,718,664 | 1/1988 | Carpenter | 272/134 |

*Primary Examiner*—Richard J. Apley
*Assistant Examiner*—David F. Crosby
*Attorney, Agent, or Firm*—Samuel M. Freund

[57] ABSTRACT

A portable leg exercising apparatus having a folded storage/travel-mode, a chair-mode for leg extension exercises, and a bench-mode for leg curl exercise. The exerciser does not use weights and includes a device for continuously adjusting the resistance to pivoting of the leg-engaging apparatus thereof while being operated by a user thereof.

8 Claims, 7 Drawing Sheets

PORTABLE LEG EXERCISER

This is a continuation of co-pending application Ser. No. 07/195,140, filed on May 17, 1988, now abandoned.

BACKGROUND OF THE INVENTION

The present invention relates generally to exercising machines and more particularly to a portable leg exerciser utilizing adjustable elastic restoring elements to generate the resistance against which a user may exercise his or her and deployable in two orientations which enable the user sitting thereon to exercise quadricep muscles while further allowing a prone user to exercise hamstring muscles.

There is considerable interest in machines useful for exercising various muscle groups. However, such machines tend to be very heavy themselves or utilize weights for supplying the forces against which the legs exercise, or both. That is, leg exercisers are not designed to be portable. For example, in U.S. Pat. No. 4,509,746, "Articulated Exercise Bench With Leg Curl Device," issued to Ernest D. Nask on April 9, 1985, the inventor teaches the use of an adjustable leg exercise device having a substantial fixed frame and a weight-receiving structure for attaching chosen weights to vary the resistance to the pivoting action of the leg-engaging members. Further, in U.S. Pat. No. 4,254,949, "Leg Curl Exercising Device," issued to Jerry D. Brentham on March 10, 1981 describes a leg exercising device having a fixed frame upon which an L-shaped seat for supporting the user is mounted, and a power cylinder for providing resistance to pivotal movement of a leg gripping member. Neither device utilizes adjustable elastic restoring elements to provide the requisite forces for exercising the legs, nor provides for a folding, light weight support structure for portability.

By contrast, in U.S. Pat. No. 3,043 591 "Combined Seating and Reclining Device and Exerciser," issued to J.W. Sellner on July 10, 1962, the inventor describes a foldable device for exercising the human body in various positions which may further be used for seating and reclining purposes. There is no mention of the use of this apparatus for leg exercises employing a variable resistance leg-engaging member.

Therefore, it is an object of the present invention to provide a portable apparatus for exercising leg muscles.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects and in accordance with the purpose of the present invention, as embodied and broadly described herein, the portable leg exerciser hereof may include a generally flat, substantially rectangular seat member pivotably attached to a generally flat, substantially rectangular back portion which can be fixedly located relative to one another in a chair mode for leg extension exercises and in a bench mode for leg curl exercises by means of a latching mechanism. Foldable floor-engaging support members and collapsible braces permit the exercise apparatus to rigidly contact the floor and stand at a convenient height, and to be folded in a storage/travel mode. Pivotable leg-engaging apparatus having elastic restoring means for providing resistance to pivoting is removably attached to the seat member. Preferably, the elastic restoring device is adjustable in tension to enable a variable resistance to pivoting of the leg-engaging apparatus to be achieved. It is also preferred that the leg-engaging apparatus have lower rollers for engaging the shins of the user for leg extension exercise. Preferably also, the leg-engaging apparatus has upper rollers for engaging the calves of the user for leg curl exercises. It is preferred that the tension of the elastic restoring device be adjustable by the user either while sitting or lying on the portable leg exerciser.

Benefits and advantages of the present invention include lightweight, portable, compact design with readily adjustable, continuously variable tensioning without the need for weights.

BRIEF DESCRIPTION OF THE DRAWINGS

The accompanying drawings, which are incorporated in and form a part of the specification, illustrate one embodiment of the present invention and, together with the description, serve to explain the principles of the invention. In the drawings.

DETAILED DESCRIPTION OF THE PREFERRED EMBODIMENT

Reference will now be made in detail to the present preferred embodiment' of the invention, an example of which is illustrated in the accompanying drawings.

Briefly, the present invention includes a portable leg exercising apparatus having a folded storage/travel mode a chair mode for leg extension exercises, and a bench mode for leg curl exercises, the apparatus being comprised of flat members, floor-engaging supports, arms, pivots, rollers, collapsible braces, and tensioning springs.

Figure 1A:
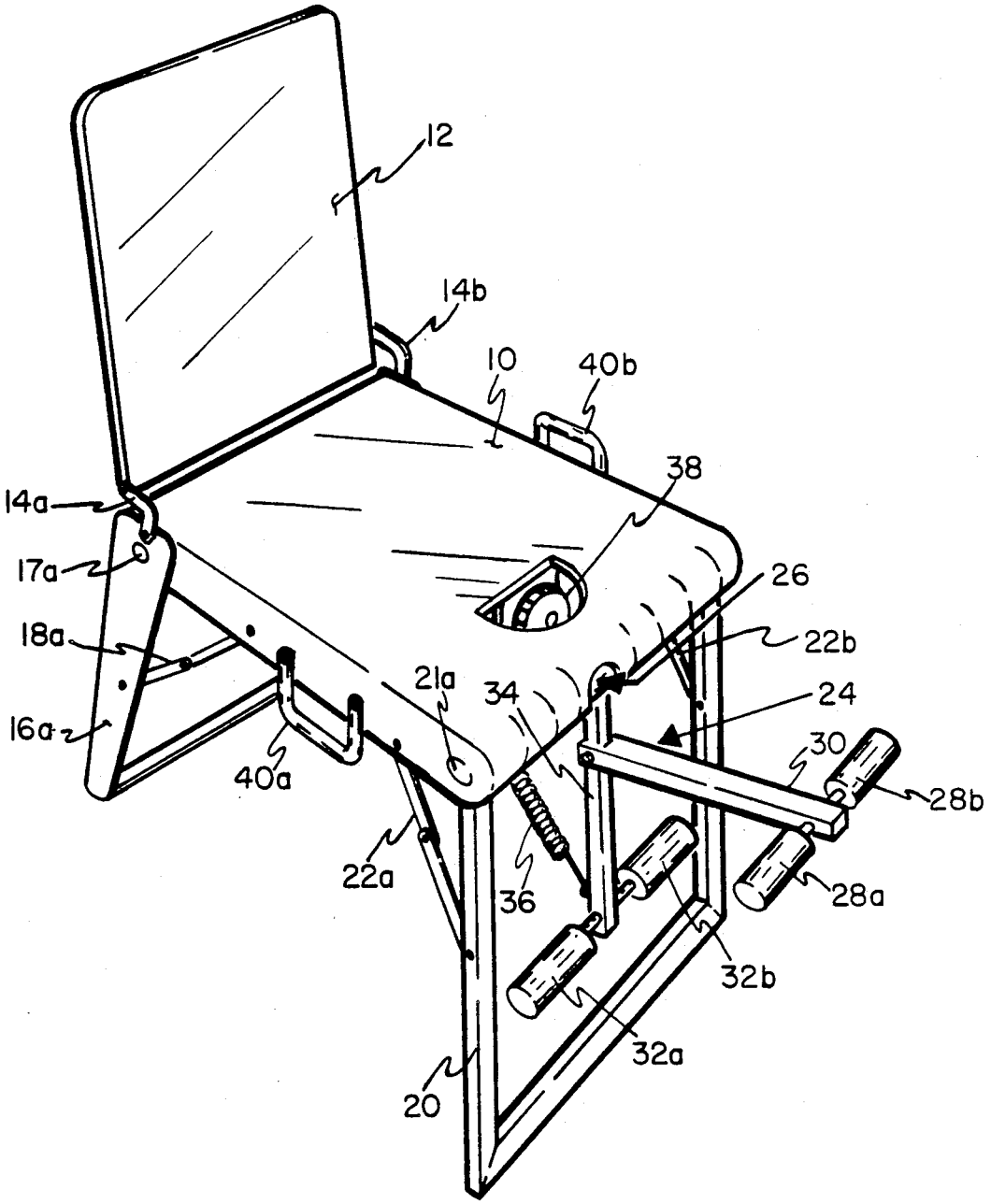
FIG. 1*a* is a schematic representation of the side view of the portable leg exerciser of the present invention in the chair mode showing generally U-shaped forward and rearward floor-engaging members supporting the chair member of the exerciser.

FIG. 1a is a schematic representation of the apparatus of the present invention deployed in the chair-mode thereof In this mode, the leg exerciser is used for leg-extension exercises with the user in a sitting position on seat member 10 with shins engaging rollers provided for leg extension exercises. A substantially flat seat member 10 is oriented in an approximately horizontal position and attached near the rearward portion thereof to a substantially flat back member 12 by latching members 14 *a, b.* The relative orientation of the seat member and the back member can be adjusted to either approximately orthogonal or substantially coplanar by means of these latching members. Seat member 10 is supported by rearward, U-shaped, floor-engaging support member 16*a* pivotably engaged at pivots 17*a, b* and reversibly locked in place by locking braces 18*a, b,* and by forward, U-shaped support member 20 pivotably engaged at pivots 21*a, b* and reversibly locked in place bY locking braces 22*a, b.* Leg-engaging apparatus 24 is pivotably attached to seat member 10 with pivot means 26. Rollers 28*a, b* located on detachable arm 30 and rollers 32*a, b* located on arm 34 provide comfortable contact with the calves and shins of the user, respectively. Adjustable resistance to the pivoting of leg-engaging apparatus 24 about pivot 26 is provided without the use of weights by elastic member 36. The means for adjustment are described hereinbelow, but handwheel 38, by which the user can make such adjustments, is located beneath seat member 10 and is accessible through a hole therein. Handles 40*a, b* provide means for stabilizing the user while operating the portable leg exerciser of the present invention in the illustrated chair mode and for carrying the leg exerciser in the travel/storage-mode thereof.

Figure 1B:
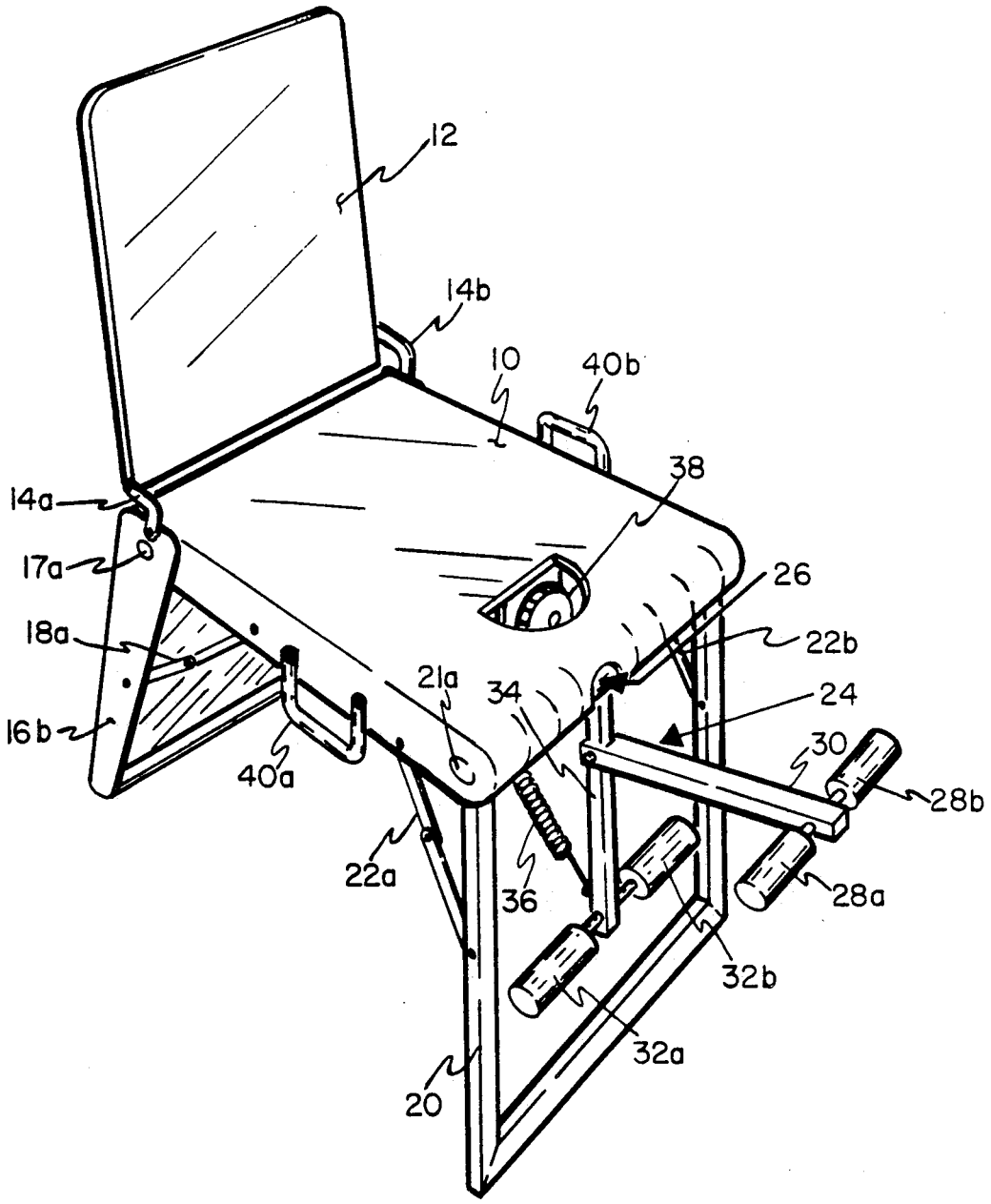
FIG. 1*b* is a schematic representation of the side view of the portable leg exerciser of the present invention in the chair mode showing a generally U-shaped front floor-engaging member and a generally rectangular rear floor-engaging member supporting the chair member of the exerciser.

FIG. 1*b* is a schematic representation of the apparatus of the present invention deployed in the chair-mode thereof. However, seat member 10 is therein supported by a generally solid rectangular, rearward floor-engaging support member 16*b* pivotably engaged at pivots 17*a, b* and reversibly locked in place by locking braces 18*a, b,* and by U-shaped support member 20 pivotably engaged at pivots 21*a, b* and reversibly locked in place by locking braces 22*a, b.* Support member 16*b* completely encloses the bottom portion of the leg exerciser when it is in its folded, storage/travel mode as will be described more fully hereinbelow, as well as providing the rearward floor-engaging means for seat member 10.

Figure 2:
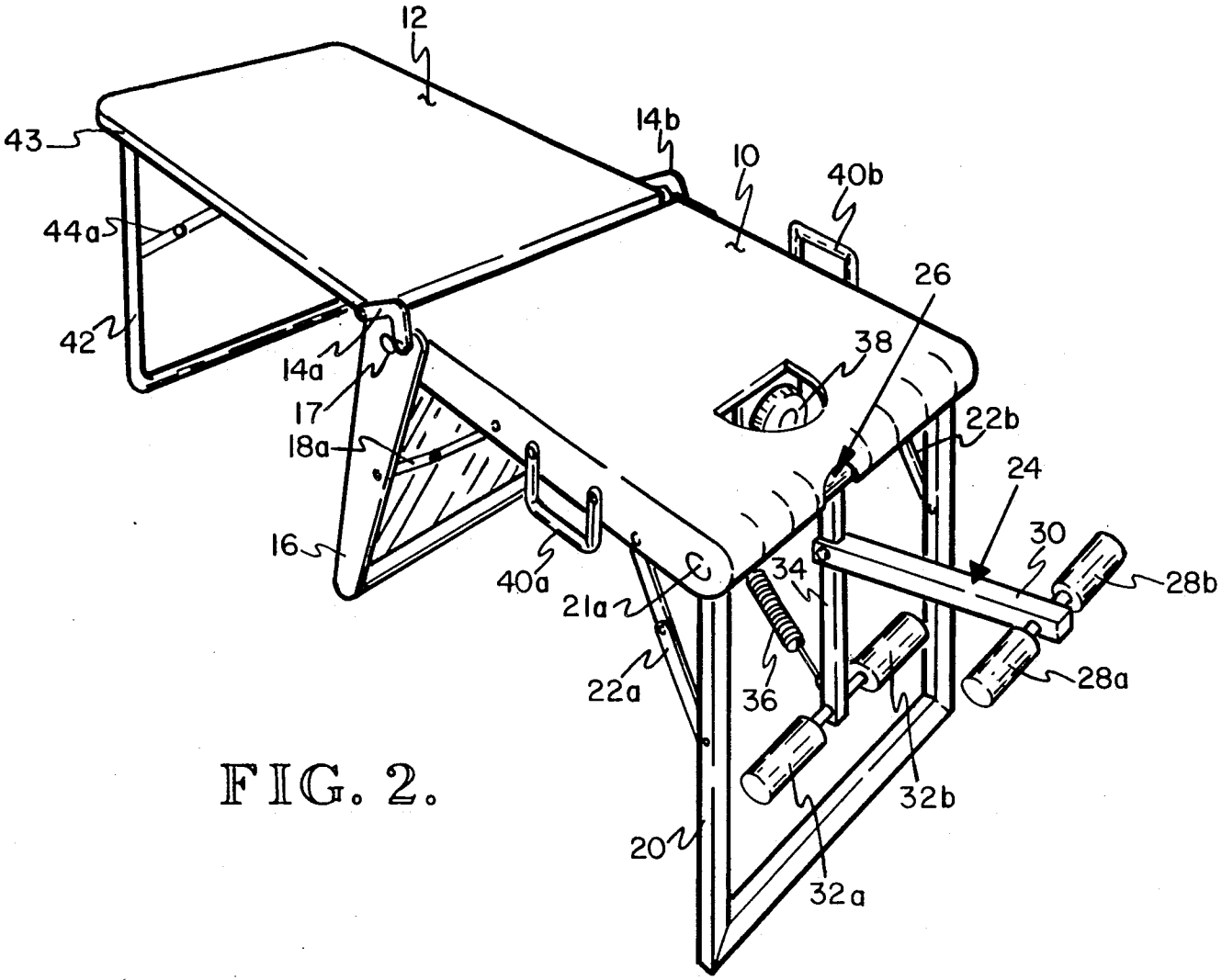
FIG. 2 is a schematic representation of of the side view of the portable leg exerciser in the bench mode.

FIG. 2 is a schematic representation of the present apparatus deployed in the bench-mode thereof. In this configuration, leg curl exercises can be performed by a user lying face-down in the prone position along seat member 10 and back member 12 with calves engaging rollers 28*a, b.* In FIG. 2, seat member 10 and back member 20 are disposed in a substantially coplanar manner. The rear, floor-engaging support member 16 for seat member 10 may be either a generally U-shaped member or a solid rectangular member as described hereinabove. In this mode, U-shaped support member 42 is pivotably engaged at pivot location 43 and reversibly locked in place by locking braces 44*a, b* to stabilize this configuration. It should be noted that latching members 14*a, b* and locking braces 18*a, b,* 22*a, b,* and 44*a, b* are constructed based on principles well-known in the art.

Figure 3:
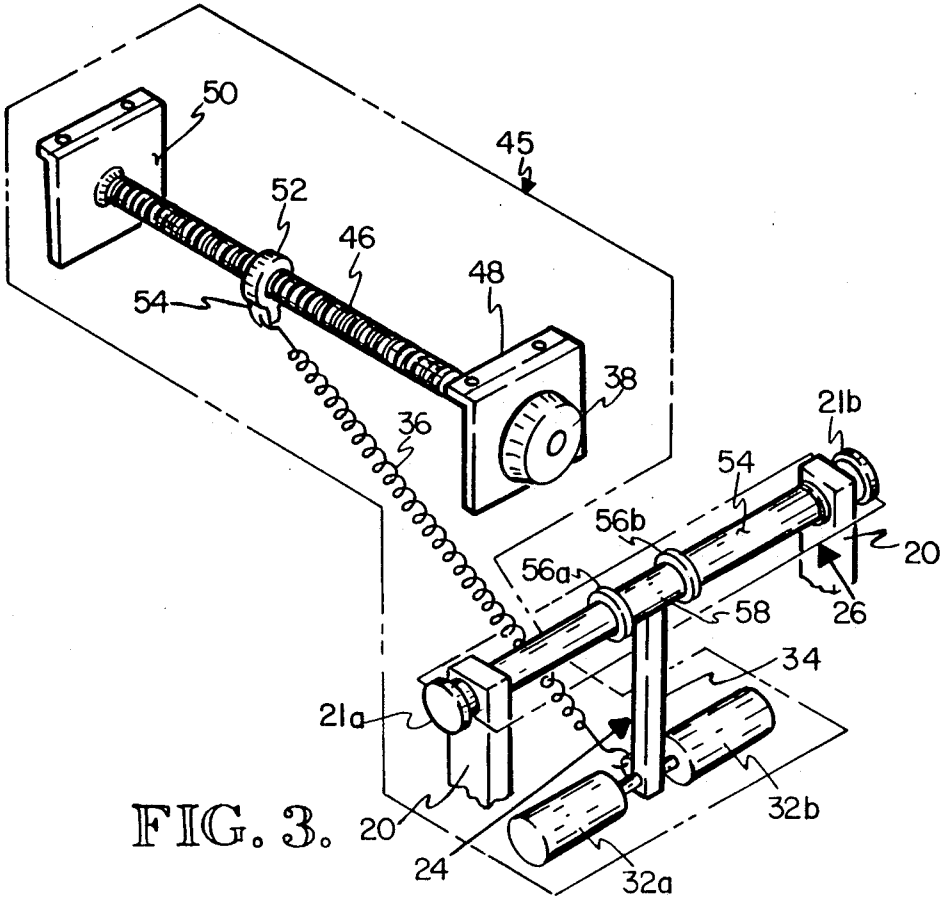
FIG. 3 is a schematic representation of an exploded view of the tension adjusting device for the leg engaging apparatus of the portable leg exerciser.

FIG. 3 is a schematic representation of adjustable tensioning device 45 for permitting the user to vary the resistance of leg-engaging apparatus 24 to pivoting. Threaded rod 46 is rotatably supported by screw-receiving mounts 48, 50. Threaded tensioning member 52 is adapted to receive threaded rod 46. Eyelet 54 provides a location for connection of elastic member 36 to tensioning member 52, the other end of elastic member 36 being connected to arm 34 near the end thereof at which rollers 32*a, b* are located. When threaded rod 46 is rotated by means of knob 38, tensioning member 52 moves forward and rearward relative to threaded rod 46, thereby decreasing or increasing, respectively, the tension provided by elastic member 36 to leg-engaging apparatus 24. Clearly, elastic member 36 could include one or more springs or elastomeric elements depending on the tension desired. FIG. 3 shows leg-engaging apparatus 24 with arm 30 detached. Pivot means 26 is also detailed showing means for attachment thereof on the underside of the seat member at pivots 21*a, b.* Cylindrical bar 54 is passes between pivots 21*a, b,* and is rigidly held thereby. Pivots 21*a, b* also pivotably engage U-shaped support member 20. Collar 58 is adapted to receive bar 54 and is rotatably located thereon Collar 58 is fixed in longitudinal position along bar 54 by collars 56*a, b,* and rigidly attached to arm 34.

Figure 4:
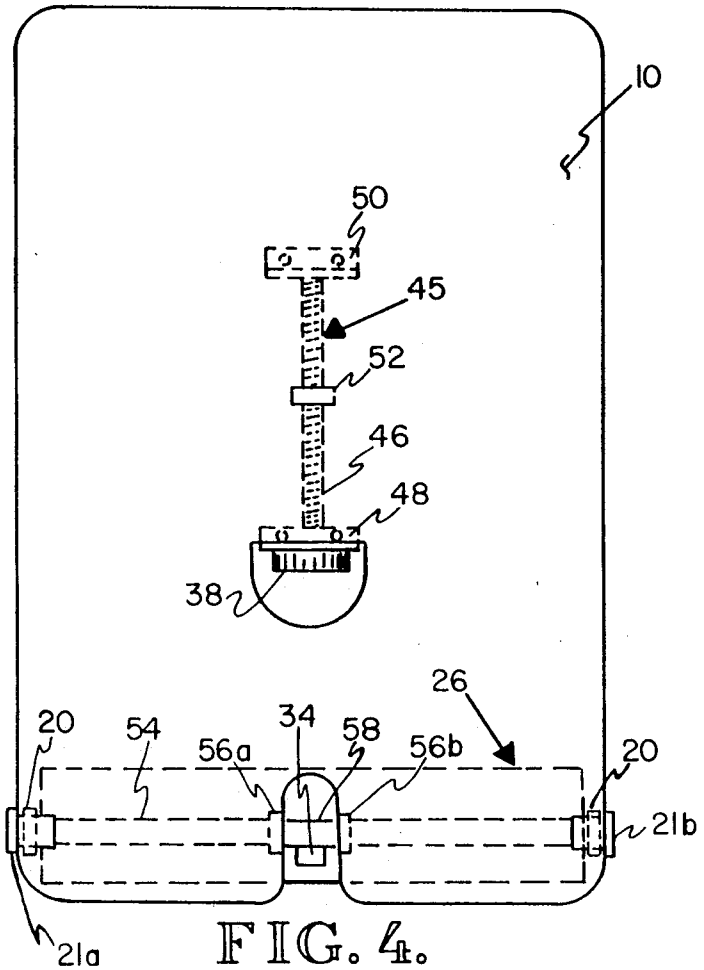
FIG. 4 is a schematic representation of the location of mounting of the tension adjusting device depicted in FIG. 3 hereof under the seat member of the portable leg exerciser.

FIG. 4 is a schematic representation of pivoting means 26 and adjustable tensioning device 45 in the operable location thereof on the underside of seat member 10.

Figure 5:
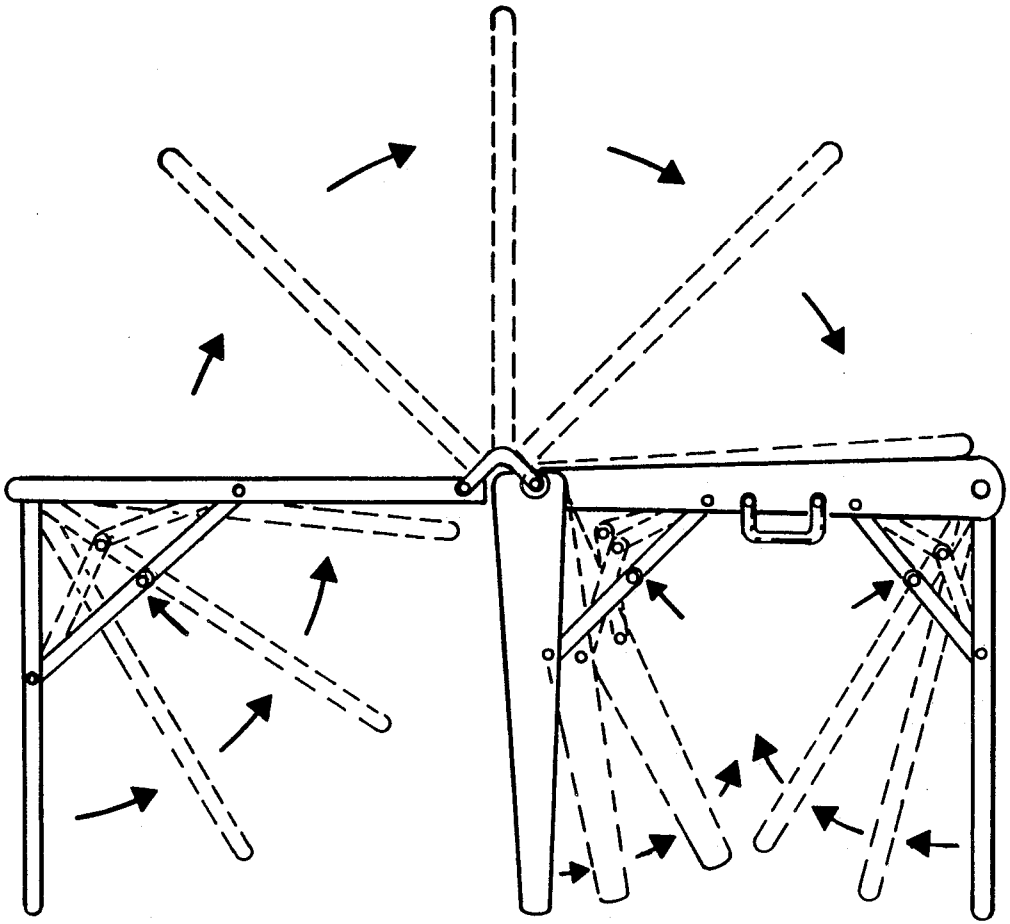
FIG. 5 is a schematic representation of the manner in which the portable leg exerciser can be folded from the bench mode to the seat mode thereof and further to the storage/travel mode thereof.

FIG. 5 is a schematic representation of the apparatus of the present invention showing the interrelationship of the bench-mode, the chair-mode and the storage/travel-mode thereof.

Figure 6:
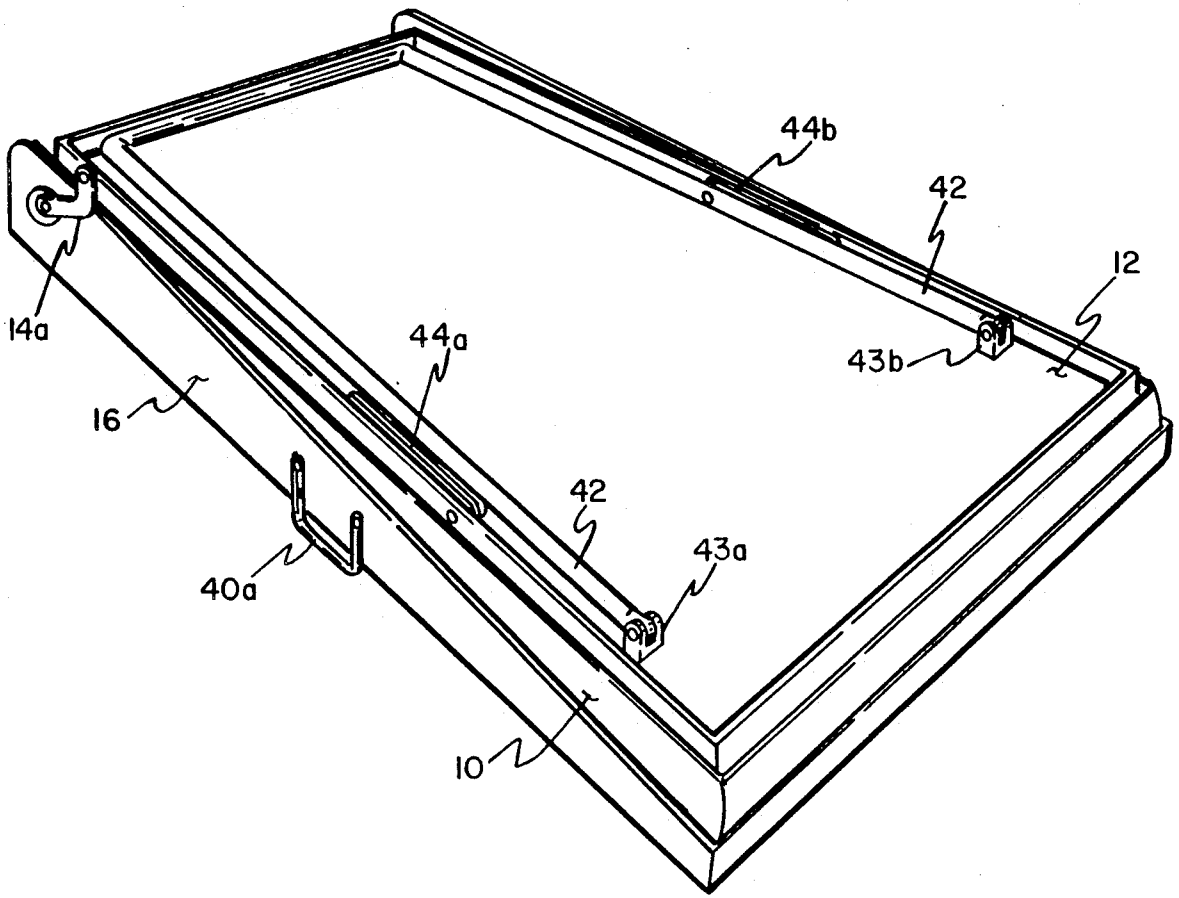
FIG. 6 is a schematic representation of the portable leg exerciser in the storage/travel mode thereof showing the back member and the floor-engaging back member support in their folded positions.

FIG. 6 is a schematic representation of a top view of the storage/travel-mode of the portable leg exerciser of the present invention.

Figure 7:
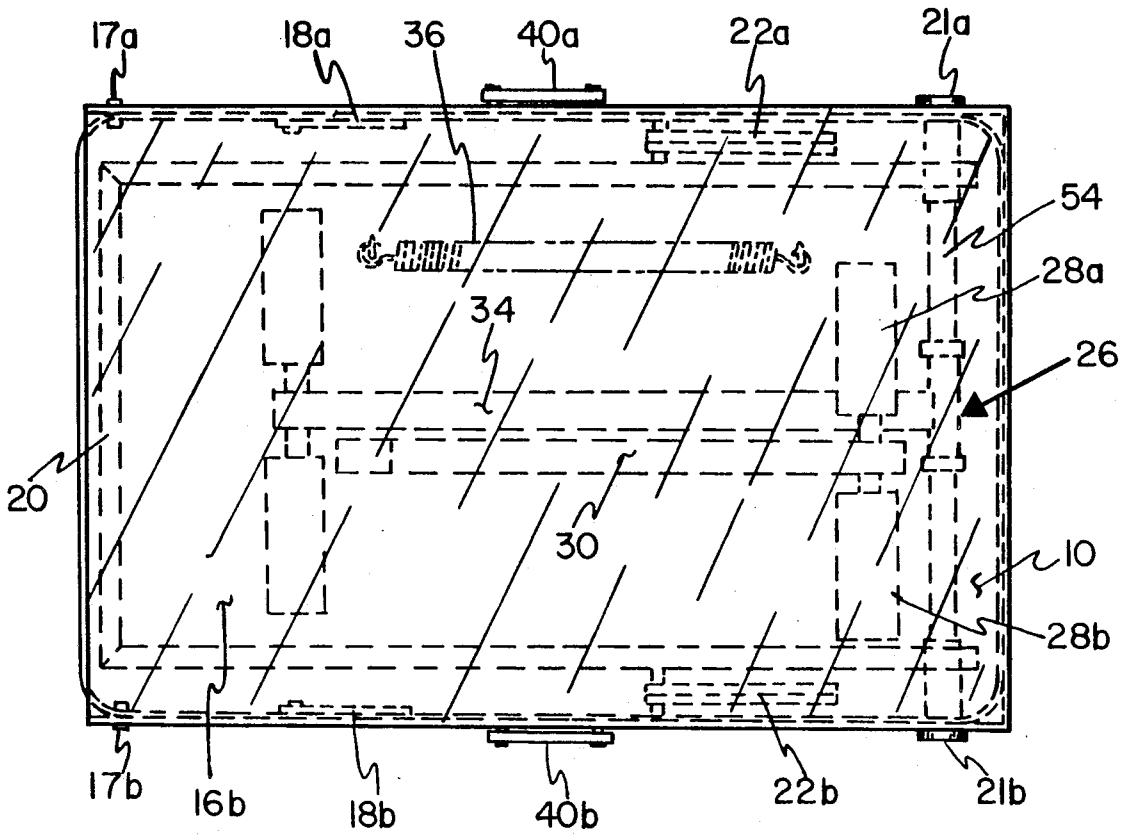
FIG. 7 is a schematic representation of the portable leg exerciser in the storage/travel mode thereof showing the demounted leg engaging apparatus and the demounted tensioning device and the folded, forward floor-engaging seat support members all located between the seat member and the rectangular, rearward floor-engaging seat support member.

FIG. 7 is a schematic representation of the bottom view of the storage/travel-mode of the portable leg exerciser of the present invention. It is to be noticed that elastic restoring member 36 and arm 30 with rollers 28*a, b* may be stored and/or transported underneath chair member 10 once these members are detached from the exerciser. Shown in FIG. 7 is the manner in which rectangular, rearward floor engaging seat support member 16*b* provides a cover for the bottom of the portable leg exerciser in its storage/travel mode.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What I claim is:

1. A portable leg exerciser which comprises in combination:

a. a substantially flat seat member having a forward portion and a rearward portion;

b. a substantially flat back member having a upper portion and and lower portion, said back member being pivotably attached in the region of the lower portion thereof to said seat member in the region of the rearward portion thereof in such a manner that said seat member and said back member can be oriented relative to one another in two deployed positions, substantially perpendicular and substantially coplanar, and substantially parallel in the folded position;

c. first locking means for securing said seat member and said back member in a chosen position;

d. a first generally U-shaped seat member support means for engaging the floor, said first seat member support means being pivotably attached near the open end thereof to said seat member in the region of the rearward portion thereof;

e. second locking means for securing said first seat member support means in the deployed orientation thereof approximately perpendicular to said seat member;

f. a second generally U-shaped seat member support means for engaging the floor, said second seat member support means being pivotably attached near the open end thereof to said seat member in the region of the forward portion thereof;

g. third locking means for securing said second seat member support means int he deployed orientation thereof approximately perpendicular to said seat member;

h. leg-engaging means pivotably connected in the region of the forward portion of said seat member deployed such that the legs of a user of said portable leg exerciser positioned on said seat member can engage said leg-engaging means;

i. substantially elastic adjustable restoring means for providing resistance to said leg-engaging means to pivoting, said adjustable restoring means comprising:

1. at least one elastic member having a first end and a second end;
2. means for connecting the first end of said elastic member to said leg-engaging means;
3. a threaded rod disposed on the side of said seat member facing the floor when said portable leg exerciser is in its unfolded orientation, said threaded rod being located substantially centrally to said seat member with the long dimension thereof orientated in the direction between the forward portion of said seat member and the rearward portion thereof;
4. means for positioning said threaded rod in such a manner that it can be rotated about its long dimension;
5. means for turning said threaded rod in either direction, said turning means being accessible by the user of said portable leg exerciser when positioned on said seat member thereof;
6. means adapted for engaging said threaded rod and advancing in either direction along said threaded rod according to the direction in which said threaded rod is turned; and
7. means for attaching the second end of said elastic member to said threaded rod engaging means;

j. a generally U-shaped back member support means for engaging the floor, said back member support means being pivotably attached near the open end thereof to said back member in the region of the upper portion thereof; and k. fourth locking means for securing said back member support means in the deployed orientation thereof approximately perpendicular to said back member when said back member is deployed in its coplanar position relative to said seat member; whereby said portable leg exerciser folds into a substantially flat unit along the region of pivot of said seat member and said back member.

2. The portable leg exerciser as described in claim 1, wherein said seat member has a hole located in its flat surface disposed in such a manner that the user of said portable leg exerciser positioned on said seat member with legs engaging said leg-engaging means can rotate said means for turning said threaded rod, thereby adjusting the resistance to pivoting thereof.

3. The portable leg exerciser as described in claim 1, wherein said at least one elastic member is a spring.

4. The portable leg exerciser as described in claim 1, wherein said at least one elastic member includes elastomeric members.

5. A portable leg exerciser which comprises in combination:

a. a substantially flat seat member having a forward portion and a rearward portion;

b. a substantially flat back member having a upper portion and and lower portion, said back member being pivotably attached in the region of the lower portion thereof to said seat member in the region of the rearward portion thereof in such a manner that said seat member and said back member can be oriented relative to one another in tow deployed positions, substantially perpendicular and substantially coplanar, and substantially parallel in the folded position;

c. first locking means for securing said seat member and said back member in a chosen position;

d. rectangular seat member support means for engaging the floor, said seat member support means being pivotably attached to said seat member in the region of the rearward portion thereof;

e. second locking means for securing said rectangular seat member support means in the deployed orientation thereof approximately perpendicular to said seat member;

f. generally U-shaped seat member support means for engaging the floor, said U-shaped seat member support means being pivotably attached near the open end thereof to said seat member in the region of the forward portion thereof;

g. third locking means for securing said U-shaped seat member support means in the deployed orientation thereof approximately perpendicular to said seat member;

h. leg-engaging mans pivotably connected in the region of the forward portion of said seat member deployed such that the legs of a user of said portable leg exerciser positioned on said seat member can engage said leg-engaging means;

i. substantially elastic adjustable restoring means for providing resistance to said leg-engaging means to pivoting, said adjustable restoring means comprising:

1. at least one elastic member having a first end and a second end;
2. means for connecting the first end of said elastic member to said leg-engaging means;

3. a threaded rod disposed on the side of said seat member facing the floor when said portable leg exerciser is in its unfolded orientation, said threaded rod being located substantially centrally to said seat member with the long dimension thereof oriented in the direction between the forward portion of said seat member and the rearward portion thereof;
4. means for positioning said threaded rod in such a manner that it can be rotated about its long dimension;
5. means for turning said threaded rod in either direction, said turning means being accessible by the user of said portable leg exerciser when positioned on said seat member thereof;
6. means adapted for engaging said threaded rod and advancing in either direction along said threaded rod according to the direction in which said threaded rod is turned; and
7. means for attaching the second end of said elastic member to said threaded rod engaging means;

j. a generally U-shaped back member support means for engaging the floor, said back member support means being pivotably attached near the open end thereof to said back member in the region of the upper portion thereof; and k. fourth locking means for securing said back member support means in the deployed orientation thereof approximately perpendicular to said back member when said back member is deployed in its coplanar position relative to said seat member; whereby said portable leg exerciser folds into a substantially flat unit along the region of pivot of said seat member and said back member, having said rectangular seat member support means and said back member as opposing sides.

6. The portable leg exerciser as described in claim 5, wherein said seat member has a hole located in its flat surface disposed in such a manner that the user of said portable leg exerciser positioned on said seat member with legs engaging said leg-engaging means can rotate said means for turning said threaded rod, thereby adjusting the resistance to pivoting thereof.

7. The portable leg exerciser as described in claim 5, wherein said at least one elastic member is a spring.

8. The portable leg exerciser as described in claim 5, wherein said at least one elastic member includes elastomeric members.

* * * * *